US009358477B1

(12) United States Patent
Copperfield

(10) Patent No.: US 9,358,477 B1
(45) Date of Patent: Jun. 7, 2016

(54) SYSTEM AND METHOD FOR CREATING AN ILLUSION

(71) Applicant: David Copperfield, Las Vegas, NV (US)

(72) Inventor: David Copperfield, Las Vegas, NV (US)

( * ) Notice: Subject to any disclaimer, the term of this patent is extended or adjusted under 35 U.S.C. 154(b) by 0 days.

(21) Appl. No.: 14/680,385

(22) Filed: Apr. 7, 2015

Related U.S. Application Data

(63) Continuation of application No. 14/169,081, filed on Jan. 30, 2014, now Pat. No. 9,017,177.

(51) Int. Cl.
*A63J 5/12* (2006.01)
*A63J 21/00* (2006.01)

(52) U.S. Cl.
CPC ..... *A63J 5/12* (2013.01)

(58) Field of Classification Search
CPC ..... A63J 5/00; A63J 5/02; A63J 5/12; A63J 21/00; A63J 99/00; A63G 2031/002
USPC ..... 472/57, 61, 68–72, 80, 81
See application file for complete search history.

(56) References Cited

U.S. PATENT DOCUMENTS 415,084 A * 11/1889 Wood ..... A63B 5/166 472/80
838,978 A * 12/1906 Goldin ..... A63J 21/00 472/71
4,244,566 A * 1/1981 Molovinsky ..... A63J 21/00 190/18 A
5,058,884 A * 10/1991 Fuller, Sr. ..... A63B 21/0615 473/438
5,318,481 A * 6/1994 St-Germain ..... B64G 7/00 472/68
6,532,606 B1 * 3/2003 Skovronski ..... A63B 5/10 4/488
7,608,019 B1 * 10/2009 Stearns ..... A63B 22/001 482/52

* cited by examiner

*Primary Examiner* — Kien Nguyen
(74) *Attorney, Agent, or Firm* — Greenberg Traurig, LLP

(57) ABSTRACT

A fixed support includes an elevated foot platform and one or more handles allowing a live person to stand on the elevated foot platform, and a background member configured to receive a portion of the fixed support and support a cutout image of a person substantially orthogonal to the live person standing on the foot platform. A picture of the live person standing on the foot platform along with the background creates the illusion in the photograph that the cutout image of the person is levitating the live person standing on the foot platform.

16 Claims, 10 Drawing Sheets

SYSTEM AND METHOD FOR CREATING AN ILLUSION

CROSS-REFERENCE

This application claims priority to U.S. patent application Ser. No. 14/169,081 filed Jan. 30, 2014 which is incorporated herein for any and all purposes.

FIELD OF THE INVENTION

The embodiments of the present invention relate to a system and method for creating an illusion and keepsake related thereto.

BACKGROUND

Illusions are staples of the magician. Various illusions provide the magician with the means to entertain and "trick" members of an audience. Unique illusions are generally maintained in secrecy and magicians are considered the gatekeepers of such illusions.

It would be useful and well-received to provide non-magicians with participation in creating an illusion and generating a keepsake related thereto. Advantageously, the system should be amenable to installation in high traffic locations (e.g., casinos, malls, etc.) to attract participants. Other attributes and features of such a system and method are detailed below.

SUMMARY

One embodiment of the present invention comprises a fixed support including an elevated foot platform and one or more handles allowing a live person to stand on said foot platform, and a background member configured to receive a portion of the fixed support and support a cutout image of a person substantially orthogonal to the live person standing on the elevated foot platform. A picture of the live person standing on the elevated foot platform along with the background creates the illusion in the photograph that the cutout image of the person is levitating the live person standing on the elevated foot platform.

One embodiment of the fixed support comprises a base, frame, elevated foot platform and one or more handles. In one embodiment, a portion of the frame is received by a background member and a live person standing on the elevated foot platform conceals the other portion of the frame allowing a photograph to be taken which depicts a levitation illusion.

In one embodiment, the support and background member may be installed in high traffic locations, like casinos, malls and sporting events, in the form of a walk-in, photo booth so that interested participants may have pictures taken showing them in a levitation illusion. In one embodiment, the background member supports or includes an image depicting a famous person (e.g., magician David Copperfield) as the individual conducting the levitation illusion.

Other variations, embodiments and features of the present invention will become evident from the following detailed description, drawings and claims.

DETAILED DESCRIPTION

Figure 1A:
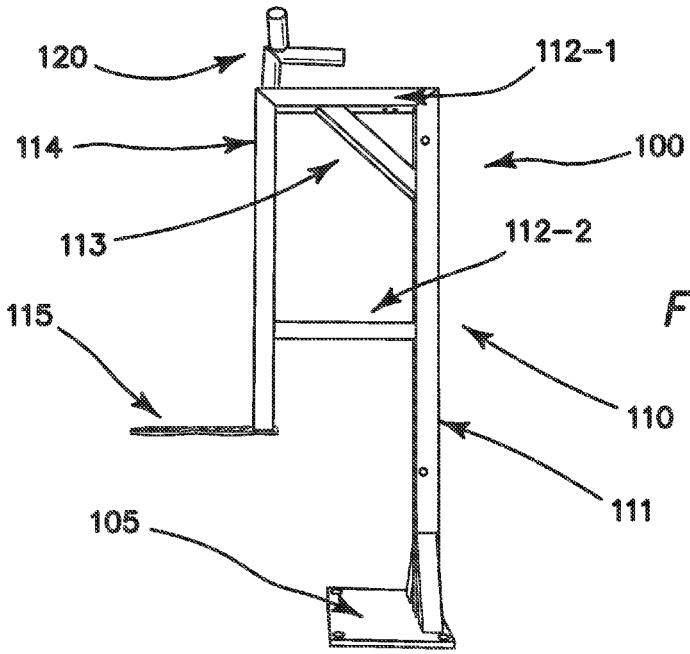
FIGS. 1*a* and 1*b* illustrate side views of a support according to the embodiments of the present invention.
Figure 1B:
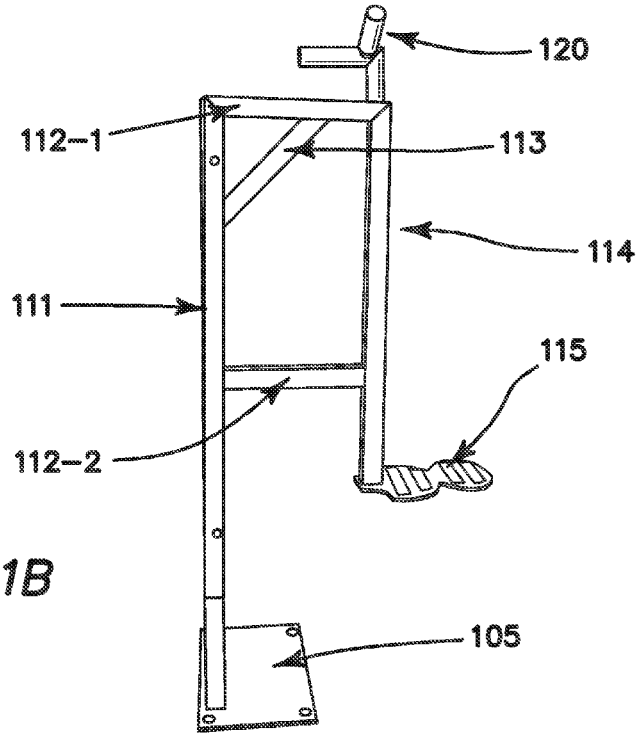
Figure 2:
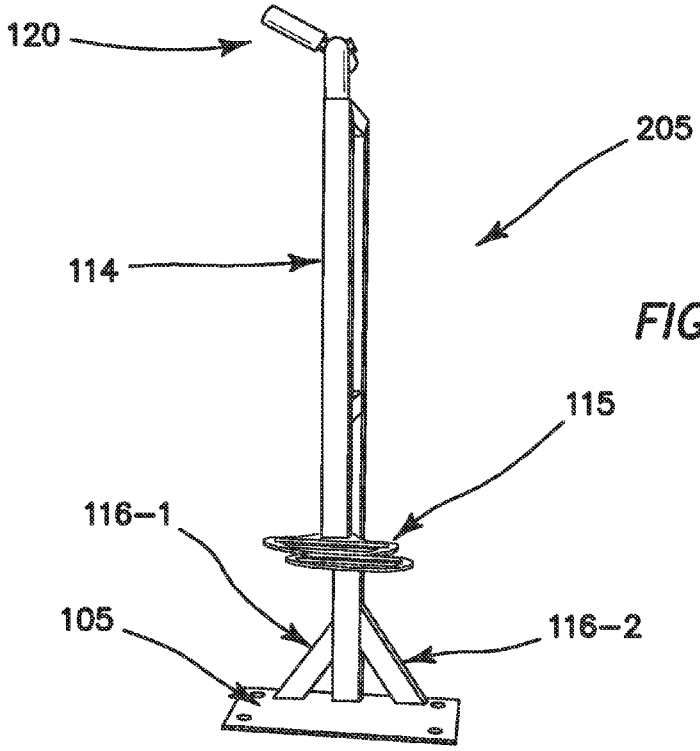
FIG. 2 illustrates a front view of a support according to the embodiments of the present invention.
Figure 3:
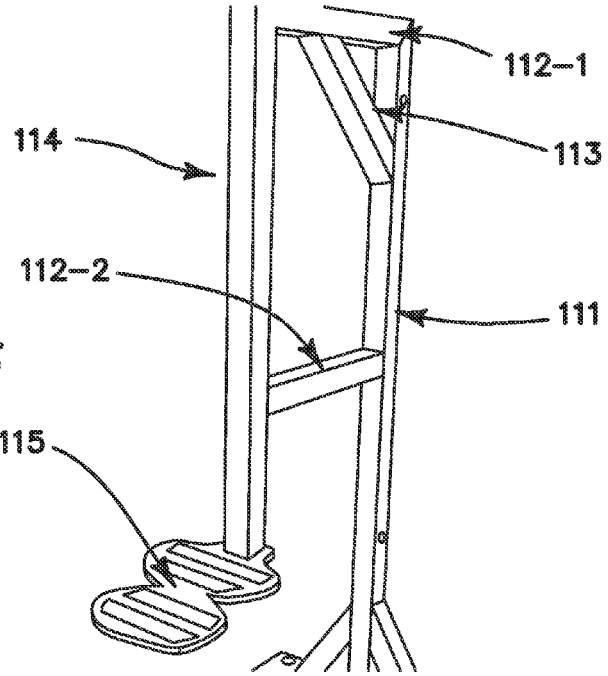
FIG. 3 illustrates an upper perspective view of a foot platform of the support according embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to those skilled in the relevant art and having possession of this disclosure, are to be considered within the scope of the invention claimed.

The components of the embodiments of the present invention may be fabricated of any suitable materials, including woods, plastics, alloys, composites, resins and metals, and may be fabricated using suitable techniques, including molding, casting, machining and rapid prototyping.

Figure 7A:
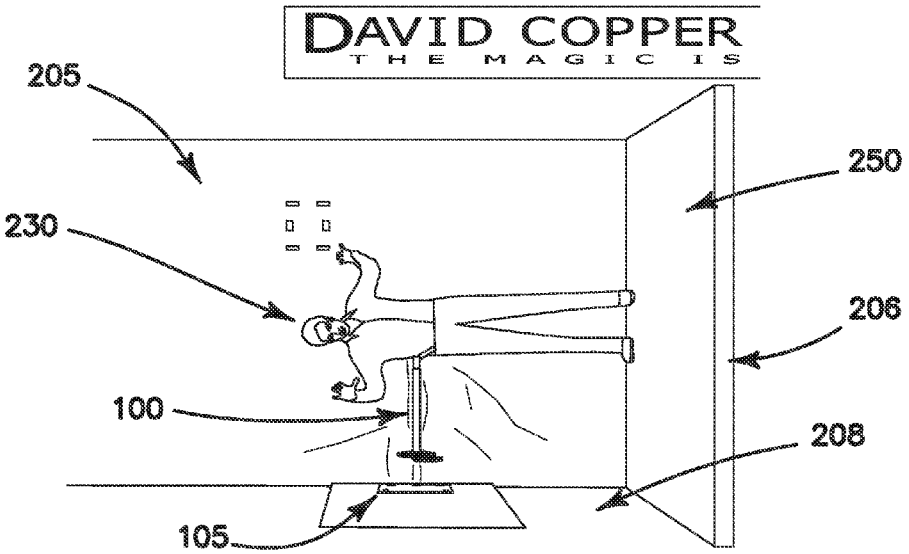
FIGS. 7*a*-7*e* illustrate props incorporated into the background member according to the embodiments of the present invention.
Figure 7B:
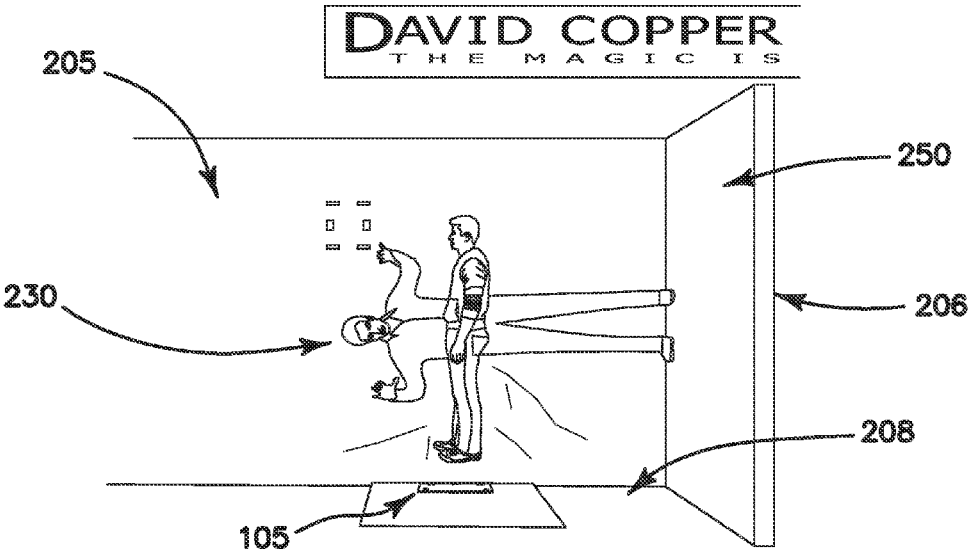
Figure 7C:
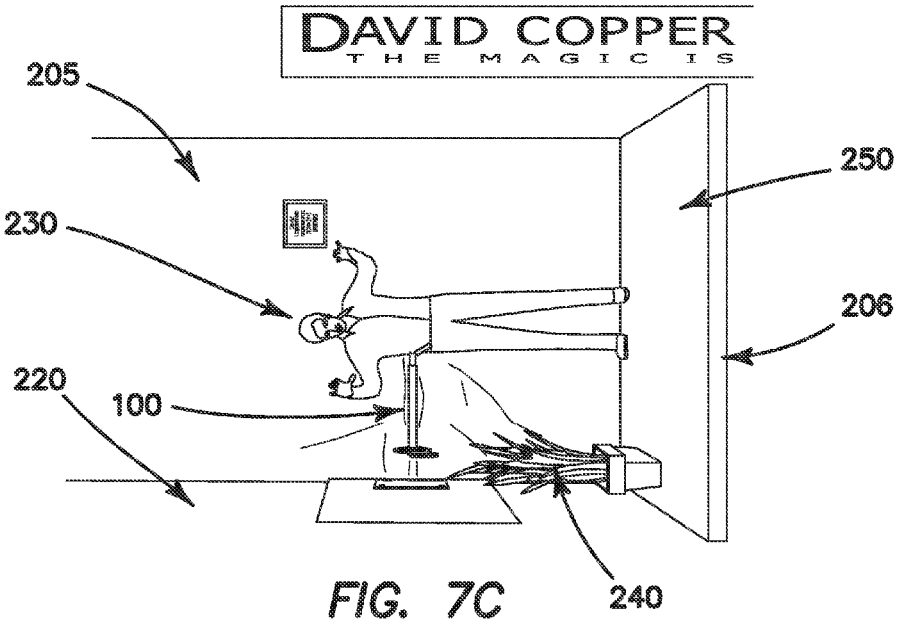
Figure 7D:
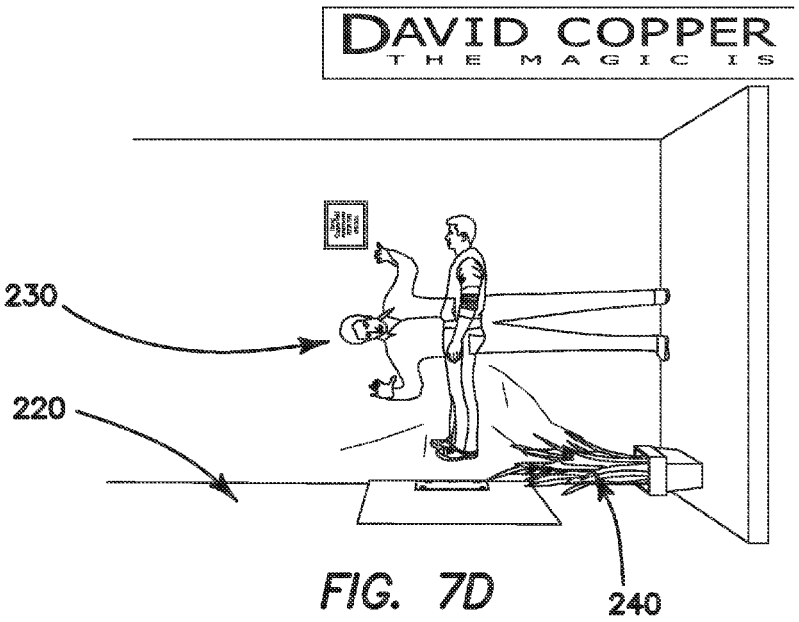
Figure 7E:
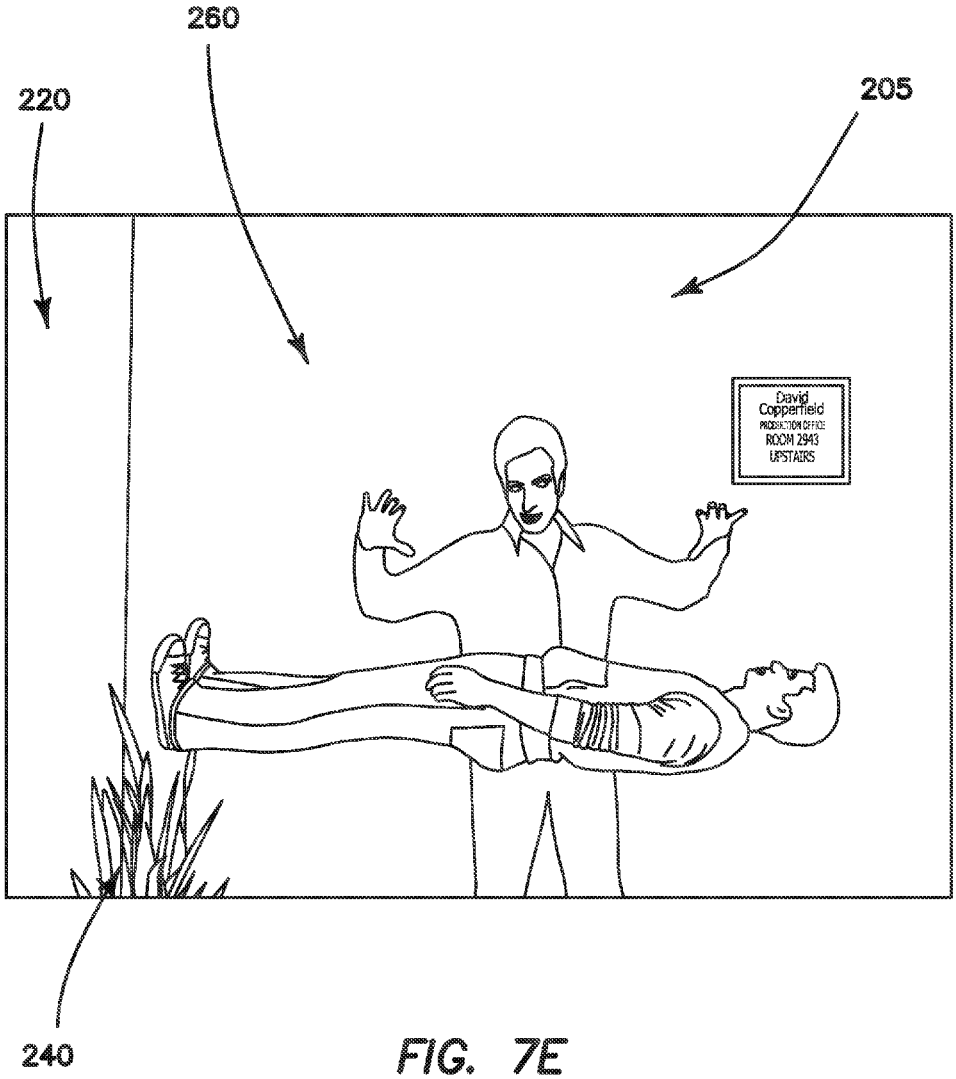

By way of reference for the remainder of this detailed description, FIG. 7*e* shows use of the support 100 (not observable in FIG. 7*e*) and background member 200 to create a keepsake photograph 260 of a levitating illusion.

FIGS. 1*a*-3 show various views of a support 100 according to the embodiments of the present invention. As shown, the support 100 comprises a base 105, frame 110, foot platform 115 and handles 120. The base 105 is configured to attach to a floor of the background member 200 or other area upon which the support 100 is positioned. In one embodiment, the base 105 includes a primary vertical member 106 extending therefrom and is bolted to the floor. As shown, the frame 110 includes a primary vertical member 111, horizontal members 112-1 and 112-2, angled support member 113, foot platform vertical member 114 and base support members 116-1, 116-2. Those skilled in the art will recognize that the frame 110 can take on many shapes and dimensions as long as the frame 100 is capable of supporting a person and being substantially concealed by the person when the person is standing on the foot platform 110. The foot platform 115 extends away from the frame 110 to provide space for the person to stand on said foot platform 115 comfortably and without interference. Grip tape 116 or similar material may be adhered to the foot platform 115 to provide additional friction.

Figure 4:
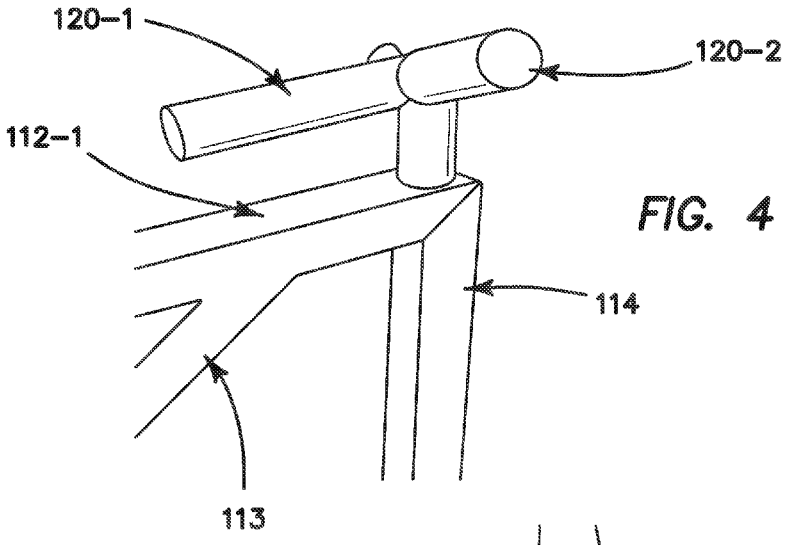
FIG. 4 illustrates a perspective view of handles of the support according to the embodiments of the present invention.

Now referencing FIG. 4, the pair of handles 120 is spaced from the foot platform 115 and provides means for a person to hold on while standing/balancing on the foot platform 115. A first handle 120-1 is substantially parallel to the ground and extends opposite the foot platform 115 and a second handle 120-2 is angled relative to the ground and substantially orthogonal to the first handle 120-1. While two handles 120-

1, 120-2 are shown, more or less handles may be implemented. Those skilled in the art will recognize that other handle configurations are possible without departing from the spirit and scope of the present invention. Also, in another embodiment, one or more handles may support objects (e.g., flowers) which further enhance the illusion by providing a sense that the individual being levitating is holding the object.

Figure 5A:
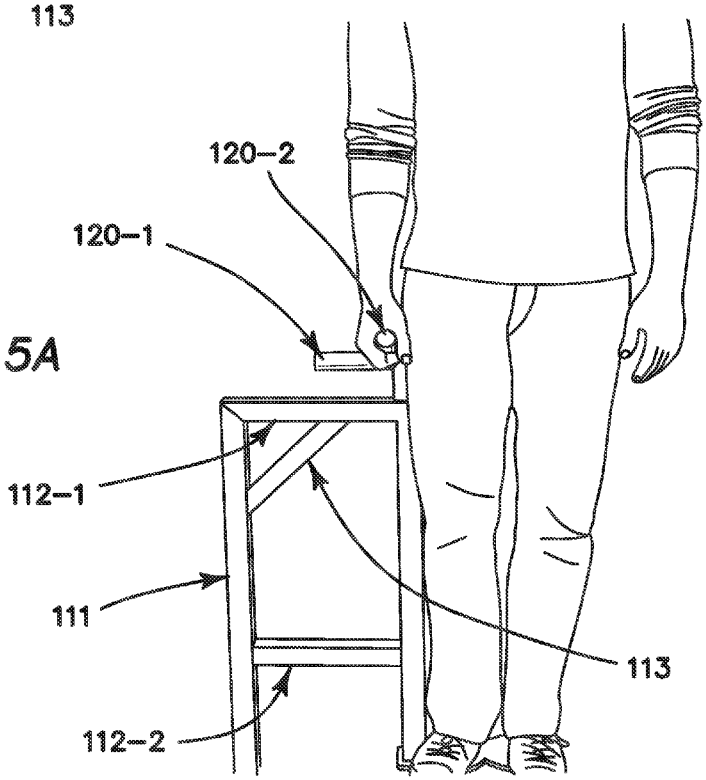
FIGS. 5*a*-5*c* illustrate several views of a live person standing on the foot platform of the support with a blank background member according to the embodiments of the present invention.
Figure 5B:
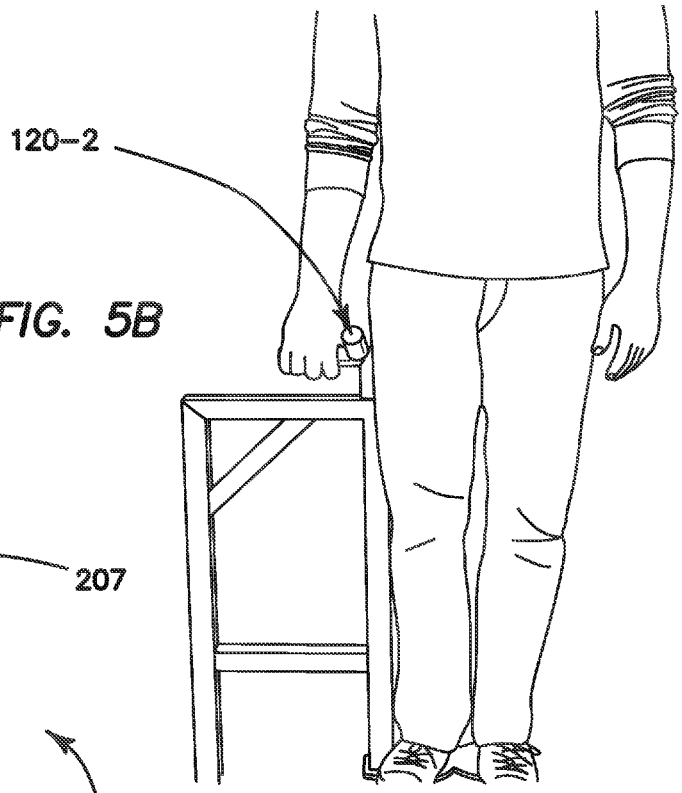
Figure 5C:
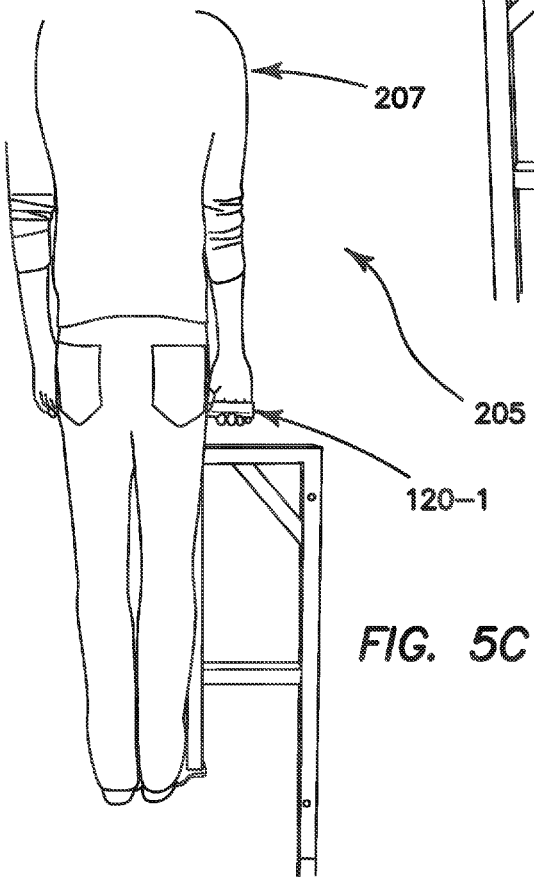
Figure 6A:
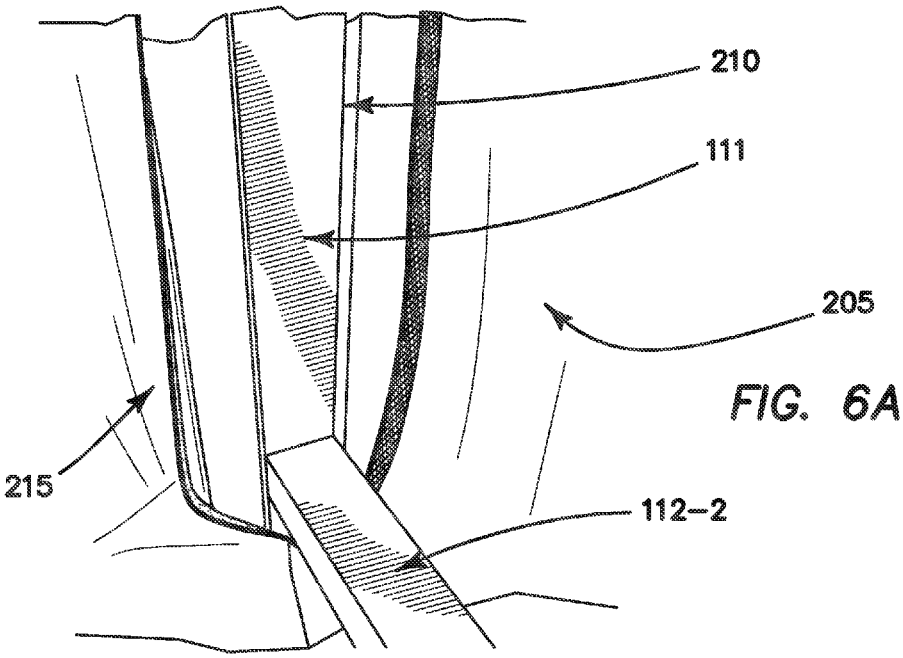
FIGS. 6*a*-6*f* illustrate views of the process of concealing a portion of the support within the background member according to the embodiments of the present invention.
Figure 6B:
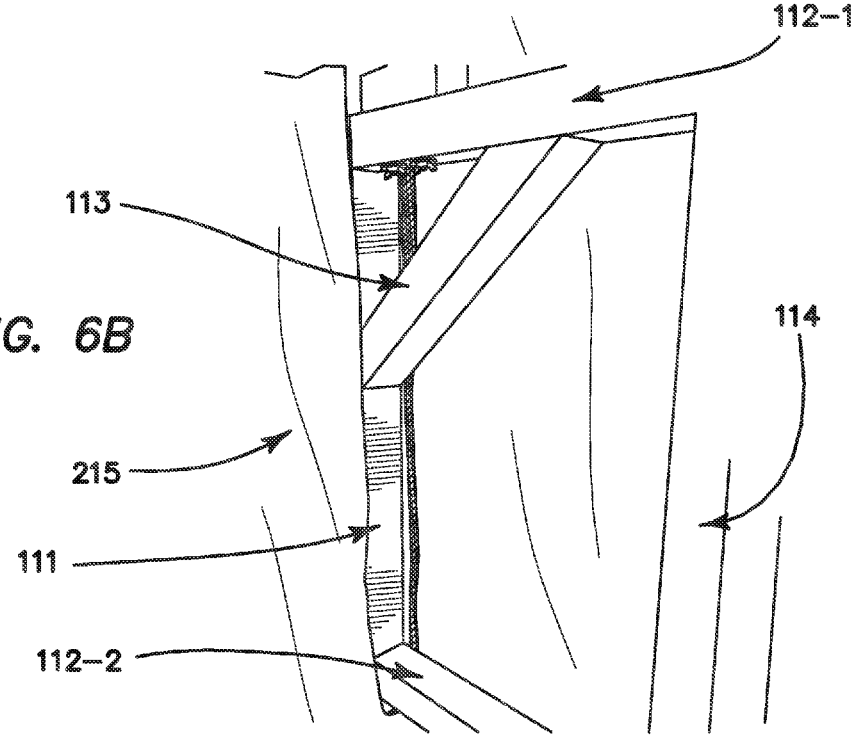
Figure 6C:
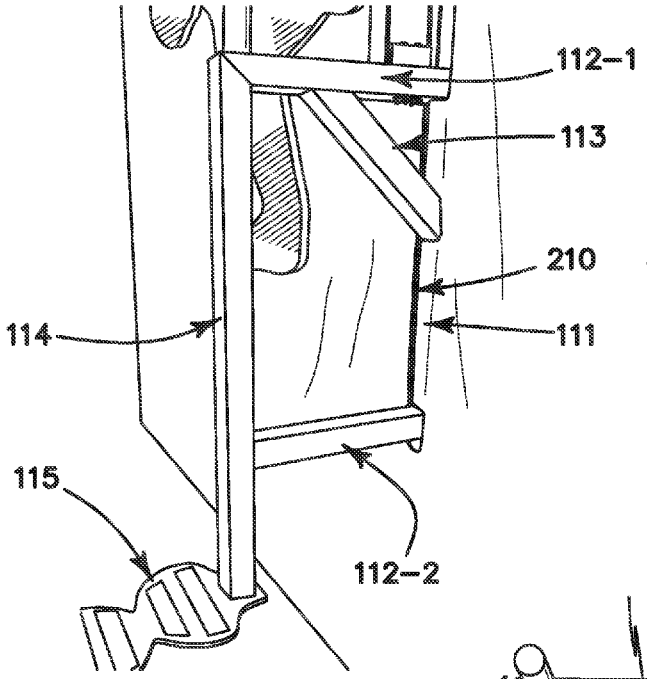
Figure 6D:
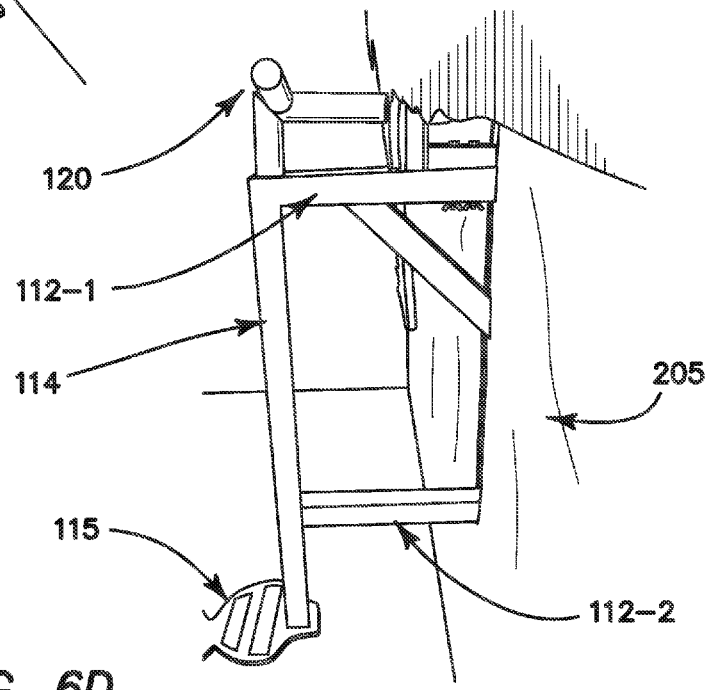
Figure 6E:
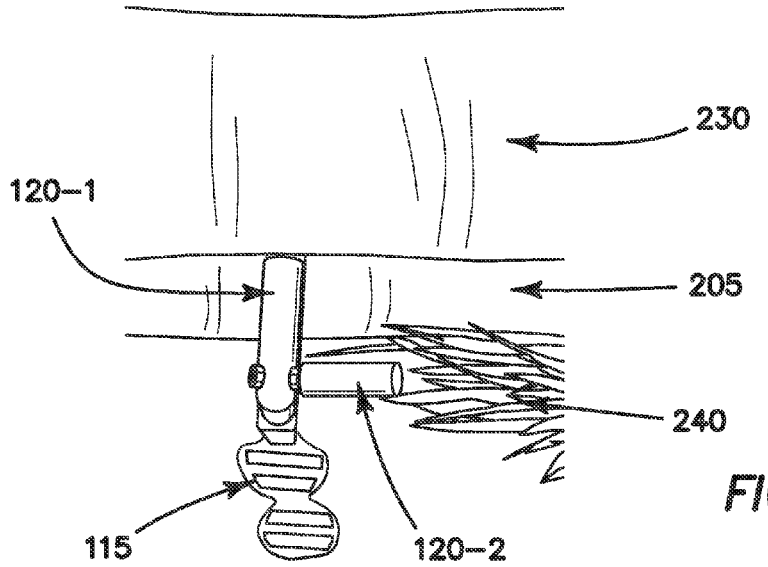
Figure 6F:
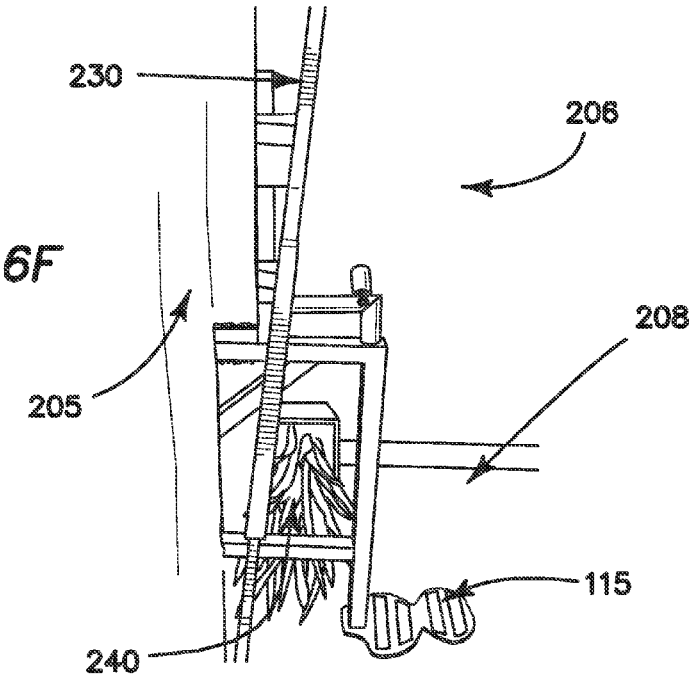

FIGS. 5*a*-5*c* show various views of a person standing on the foot platform 115. As shown, the person can grip the handles 120-1 and 120-2 to assist with maintaining balance while standing on the foot platform 115. The handles 120 may be covered with grips, tape or other material for providing additional friction with a person's hand.

In practice, the support 100 is incorporated in, or positioned proximate, the background member 200. The background member 200 may be as simple as two walls and floor or a collection of three walls and floor forming a defined space/room. The floor may be any stable surface including a traditional floor, slab, ground or similar article which is capable of maintaining the support 100 and person standing thereon. It is envisioned that the support 100 and background member 200 will be installed in high traffic locations such that the public will be able to participate by standing on the foot platform 115 and having a photograph taken depicting a levitation illusion (see, FIG. 7*e*).

FIGS. 6*a*-6*f* show the support 100 integrated with a wall 205 of the background member 200 such that at least a portion of the support 100, including the base 105 is received by the wall 205. The wall 205 extends upward from a floor adjacent to the base 105. In one embodiment, the wall 205 meets the floor adjacent to a front edge of the primary vertical member 210 of the frame 110. A cut-out 210 in the wall 205 permits the horizontal members 112-1, 112-2 and the angled support member 113 of the frame 110 to extend outward from the cut-out 210. In one embodiment, a fabric covering 215 is placed over the wall 205 helping to conceal the cut-out 210 as well as providing an aesthetically pleasing look. A carpet or flooring material 220 conceals the portion of the base 105 not concealed by the wall 205.

FIGS. 7*a*-7*e* show a background member 200 formed of wall 205, wall 206, wall 207 and floor 208. A support 100 is positioned within the background member 200 as described above. A may be attached to wall 205 and/or wall 206. Other props, such as a potted plant 235, may be attached to wall 205 and/or wall 206 in an orthogonal relationship with the support 100. Wall 206 is covered in carpeting 250 of a different color than the other walls 205, 207 and floor 208. As shown, in FIG. 7*e*, a photograph of the background member 200 with a person standing on the foot platform 115 creates a levitation illusion when the photograph is turned 90 degrees or the photograph may be taken at a 90 degree offset. The cut-out image 230, potted plant 240 (and any other props) and carpeting 250 are utilized to facilitate the creation of the illusion. In one embodiment, the background member 200 is curved in a concave or convex fashion to further add to the ability to create illusions.

In another embodiment, the background member 200 is modified to make it appear that both the magician and individual are floating rather than the illusion of the magician levitating the individual. The modification involves moving the cut-out image 230 to a position along wall 205 where the feet of the cut-out image 230 are no longer flush with an edge thereof. For example, in FIG. 7*a*, the cut-out image 230 would be moved to the left to a more central position.

Although the invention has been described in detail with reference to several embodiments, additional variations and modifications exist within the scope and spirit of the invention as described and defined in the following claims.

I claim:

1. A system comprising:

a background member and floor;

a support, including at least a frame, base and elevated foot platform, said support configured to support a person;

an image of a person positioned substantially orthogonal behind said support;

wherein said support and image of said person cooperate to create an illusion of said person being levitated when said person stands on said support and wherein said background member is configured to conceal at least a portion of said support.

2. The system of claim 1 further comprising means for concealing said base and a portion of said frame below said elevated foot platform.

3. The system of claim 1 wherein said support further includes one or more handles.

4. The system of claim 1 further comprising a background member and floor.

5. The system of claim 1 further comprising one or more props positioned substantially orthogonal to said support.

6. A system comprising:

a background member and floor;

a support, including at least a frame, base and elevated foot platform, said support configured to support a person;

an image of a person positioned substantially orthogonal behind said support;

wherein said support and image of said person cooperate to create an illusion of said person being levitated when said person stands on said support; and wherein said floor is configured to conceal at least a portion of said support.

7. The system of claim 6 further comprising means for concealing said base and a portion of said frame below said elevated foot platform.

8. The system of claim 6 wherein said support further includes one or more handles.

9. The system of claim 6 further comprising a background member and floor.

10. The system of claim 6 further comprising one or more props positioned substantially orthogonal to said support.

11. A method of creating an illusion comprising:

positioning an image of a person behind and orthogonal relative to a support, said support including a frame, base and elevated foot platform for supporting a person;

concealing at least said base and a portion of said frame below said elevated foot platform; and taking a photograph of said person standing on said support in front of said image of said person.

12. The method of claim 11 further comprising positioning one or more props substantially behind and orthogonal to said support.

13. The method of claim 11 further comprising positioning a wall behind said support and concealing at least a portion of said support by said wall.

14. The method of claim 11 further comprising positioning a floor beneath said support and concealing at least a portion of said support by said floor.

15. The method of claim 11 further comprising positioning a curved wall behind said support and concealing at least a portion of said support by said wall.

16. The method of claim 11 further comprising ensuring, before taking said photograph, that said support is not visible from a front view of said image of a person when a person is standing on said foot platform.

* * * * *